US010959494B2

(12) United States Patent
Spicher et al.

(10) Patent No.: US 10,959,494 B2
(45) Date of Patent: Mar. 30, 2021

(54) PORTABLE RATCHET FOOTWEAR TIGHTENING SYSTEM

(71) Applicant: D&J INNOVATIONS, LLC, Dauphin, PA (US)

(72) Inventors: Denny Spicher, Dauphin, PA (US); Joshua Spicher, Dauphin, PA (US); Jeremy Spicher, Mechanicsburg, PA (US)

(73) Assignee: D&J INNOVATIONS, LLC, Dauphin, PA (US)

( * ) Notice: Subject to any disclaimer, the term of this patent is extended or adjusted under 35 U.S.C. 154(b) by 0 days.

(21) Appl. No.: 16/542,386

(22) Filed: Aug. 16, 2019

(65) Prior Publication Data

US 2020/0054100 A1 Feb. 20, 2020

Related U.S. Application Data

(60) Provisional application No. 62/764,931, filed on Aug. 16, 2018.

(51) Int. Cl.
*A43C 11/00* (2006.01)
*A44B 11/06* (2006.01)

(52) U.S. Cl.
CPC ..... *A44B 11/065* (2013.01)

(58) Field of Classification Search
CPC ..... A44B 11/065
See application file for complete search history.

(56) References Cited

U.S. PATENT DOCUMENTS 3,173,182 A * 3/1965 Teufel ..... A43C 11/1406 24/68 SK
3,224,118 A * 12/1965 Tenfel ..... A43C 11/1406 36/117.8
3,292,222 A * 12/1966 Steinberg ..... A43C 11/1406 24/68 SK
3,363,288 A * 1/1968 Lange ..... A43C 11/148 24/68 SK
3,599,296 A * 8/1971 Baso ..... A43C 11/1413 24/70 SK
3,662,435 A * 5/1972 Allsop ..... A43C 11/1413 24/70 SK
4,112,557 A * 9/1978 Salomon ..... A43C 11/1413 24/69 SK (Continued)

*Primary Examiner* — Jason W San
(74) *Attorney, Agent, or Firm* — McNees Wallace & Nurick LLC

(57) ABSTRACT

Described is a portable footwear tightener lace replacement (mechanism) for use with an ice skate, sports shoe, work boot, sneaker or other footwear that has eyelets or lace hooks and normally uses laces for tightening. The portable footwear tightener includes an inside strap having a tooth or ribbed top side, an inside strap footwear attachment structure, an outside strap having a ratchet or clasp/buckle mechanism, an outside strap footwear attachment structure. Each of the inside strap and the outside strap is attached to the footwear through the eyelets, hooks or hoops by the inside strap footwear attachment structure and the outside footwear attachment structure, respectively, and the ribbed or toothed portion of the inside strap is connectable to ratchet or clasp/buckle mechanism of the outside strap into a snug arrangement.

12 Claims, 13 Drawing Sheets

(56) References Cited

U.S. PATENT DOCUMENTS 4,310,951 A * 1/1982 Riedel ..... A43C 11/1413 24/68 SK
5,251,388 A * 10/1993 Pozzobon ..... A43C 11/1413 24/68 SK
5,575,045 A * 11/1996 Chu ..... A43C 11/146 24/68 SK
5,647,104 A * 7/1997 James ..... A43C 11/008 24/68 SK
5,701,639 A * 12/1997 Chen ..... A43C 11/1406 24/629
6,250,651 B1 * 6/2001 Reuss ..... A43C 11/1406 24/70 SK
6,293,566 B1 * 9/2001 Carpenter ..... A63C 10/04 280/14.21
6,412,147 B1 * 7/2002 Chen ..... A43C 11/1413 24/68 SK
6,554,297 B2 * 4/2003 Phillips ..... A43C 11/1413 24/68 SK
6,622,400 B2 * 9/2003 Bollard ..... A43C 11/1406 24/68 SK
6,640,396 B1 * 11/2003 Lin ..... A43C 11/148 24/191
6,729,047 B2 * 5/2004 Hirayama ..... A43B 3/0031 24/68 SK
7,866,065 B2 * 1/2011 Munns ..... A43B 5/145 24/68 SK
7,877,845 B2 * 2/2011 Signori ..... F16B 2/08 24/68 SK
8,763,209 B2 * 7/2014 Kavarsky ..... A43C 11/1413 24/68 SK
8,763,210 B2 * 7/2014 Vincent ..... A43B 5/04 24/68 SK
9,814,281 B2 11/2017 Fisher et al.
2003/0041418 A1 * 3/2003 Berlese ..... A43C 11/1433 24/68 SK
2004/0148741 A1 * 8/2004 Hsiao ..... A43C 11/148 24/68 SK
2006/0156517 A1 * 7/2006 Hammerslag ..... A43C 1/04 24/68 SK
2006/0260101 A1 * 11/2006 Holzer ..... A43B 5/0452 24/68 SK
2008/0209702 A1 * 9/2008 Van Dine ..... A44B 11/12 24/68 SK
2008/0263901 A1 * 10/2008 Chaigne ..... A43C 11/142 36/117.1
2011/0000057 A1 * 1/2011 Abdul ..... A43C 11/146 24/68 SK
2012/0297591 A1 * 11/2012 Bozzetto ..... A43C 11/146 24/68 SK
2013/0047388 A1 * 2/2013 Kavarsky ..... A43C 11/142 24/68 SK
2013/0091674 A1 * 4/2013 Chen ..... A43C 11/146 24/68 SK
2015/0059135 A1 * 3/2015 Benetti ..... A43C 11/144 24/68 SK
2015/0289593 A1 * 10/2015 Quagliotto ..... A43C 11/12 36/115
2016/0175688 A1 * 6/2016 Gelin ..... A63C 5/03 280/14.22
2017/0202314 A1 * 7/2017 Song ..... A43C 11/1493
2018/0360167 A1 12/2018 Zoulamian

* cited by examiner

PORTABLE RATCHET FOOTWEAR TIGHTENING SYSTEM

RELATED APPLICATIONS

This application is based on, claims priority to, and incorporates herein by reference in its entirety, U.S. Provisional Patent Application Ser. No. 62/764,931, filed on Aug. 16, 2018, and entitled "Shoe clasp".

FIELD OF THE INVENTION

The present invention is directed to fasteners and tighteners, and more specifically relates to footwear fasteners and accessories.

BACKGROUND OF THE INVENTION

Footwear is a basic necessity for most athletes and professionals who work in harsh environments. The market for athletic footwear and work boots is vast with many choices for the general user. In addition to style of footwear for specific sports or work environments, there are individual styles and attributes available based on personal preference.

The most common form of providing support, stability and secureness to the foot, across the board, are laces. Laces have their place, but some athletes and workers find them to be cumbersome and unreliable, they take time to fasten and they come untied. When time could mean a missed play, the last thing athletes want to do is tie their shoes. When the job needs to be completed, workers are not thinking about the safety of their laces. Younger athletes, who don't have the strength or dexterity to retie laces while on the field of play, require the help of an adult. Footwear utilizing laces can cause a delay in play and potential for missed opportunities.

Whether it is young athletes who struggle to lace up their footwear themselves, professional or recreational athletes who are looking to shave seconds off their prep time or equipment downtime or workers looking for reliable yet stable boot fasteners to alleviate another safety issue, laces suffer from significant drawbacks.

Accordingly, what is needed is an improved way to comfortably and quickly tighten shoes, in essentially any environment.

SUMMARY OF THE INVENTION

In accordance with an aspect of the invention, there is provided a portable latch style fastener for use with a skate, shoe or boot having eyelets or hooks typically used for laces. The portable latch style fastener includes an inside toothed or ribbed strap with one of the following: eyelet screw or screws with backplate, hook or loop attachments, of a quantity of one, two, three or more eyelet or hook connection points; an outside strap with matching eyelet or hook attachments and a clasp/buckle for use with the inside toothed strap or ratchet latch receiver for use with the ribbed inside strap.

According to an embodiment of the invention, there is provided a set of three portable latching mechanisms with a combination of eyelet or hook attachment quantities described above. Thus, allowing up to three attachment locations along the footwear which meet the desired support and comfort level of the user. The latch is adjustable by nature, whereas the inside strap is inserted through the clasp on the outside strap until even with the footwear, then the ratchet is used to tighten the shoe as desired. The latch may be tightened and untightened by operating the ratchet clasp.

According to an embodiment of the invention, there is provided a portable footwear tightener for footwear having eyelets or eyelet hooks. The portable footwear tightener includes an inside strap having a tooth or ribbed top side, an inside strap footwear attachment structure, an outside strap having a ratchet or clasp/buckle mechanism, an outside strap footwear attachment structure. Each of the inside strap and the outside strap is attached to the footwear through the eyelets, hooks or hoops by the inside strap footwear attachment structure and the outside footwear attachment structure, respectively, and the ribbed or toothed portion of the inside strap is connectable to ratchet or clasp/buckle mechanism of the outside strap into a snug arrangement.

According to a further embodiment, the present invention provides an alternate eyelet means of attachment of an eyelet hook, in lieu of the rivet screws, of like number of connection points.

According to a further embodiment, the present invention provides an alternate eyelet means of attachment of a hoop, in lieu of the rivet screws, of like number of connection points.

According to a further embodiment, the present invention provides an alternate latching mechanism such that a clasp of similar function as that of a wrist watch combined with previously mentioned means of shoe attachments. Wherein, the clasp can be decorated for custom designs.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
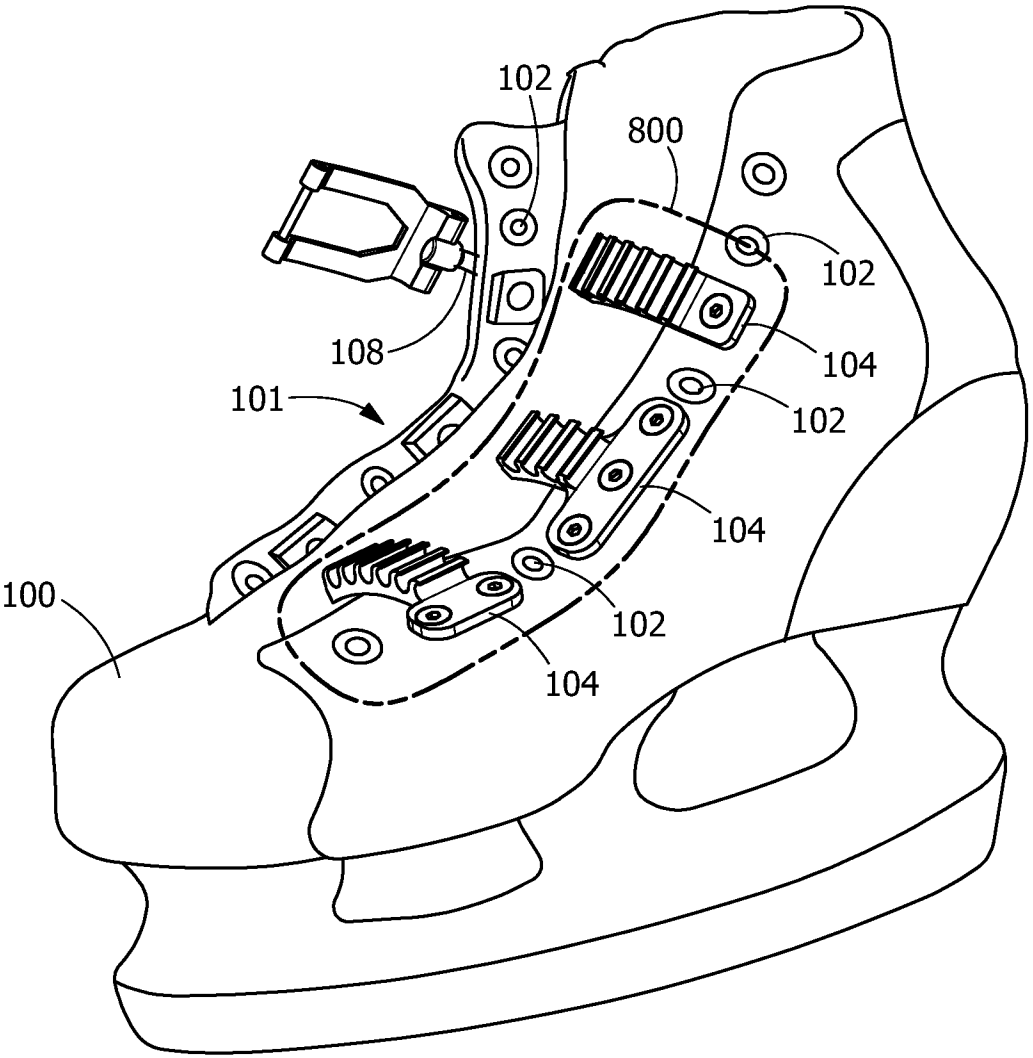
FIG. 1 is a perspective view of footwear including a portable footwear tightener according to an embodiment of the present invention.

Referring now to FIG. 1, footwear 100 including a portable footwear tightener 101 installed thereon. The footwear 100 shown in FIG. 1 includes an ice skate, but is not so limited. Suitable embodiments of footwear 100 include, but are not limited to, shoes, sneakers, boots, sandals, athletic shoes, skates, work boots. The portable footwear tightener 101 includes a plurality of inside straps 104 (see, for example, FIGS. 2-4) and outside straps 108 connected to footwear 100 via eyelets 102. Eyelets 102 include eyelets that are typically or conventionally found on footwear and may include openings through which laces or similar structures would normally be fed to tighten the footwear. For convenience, a single set of these elements, which function as a portable clasp footwear tightener may, as an individual set, be designated as latching mechanism regardless of the number of eyelets. As indicated in greater detail below, each section of parts combines to form one latch mechanism which fastens to the right and left side of the footwear using the respective number of eyelets held in place by fasteners and back plates.

Figure 2:
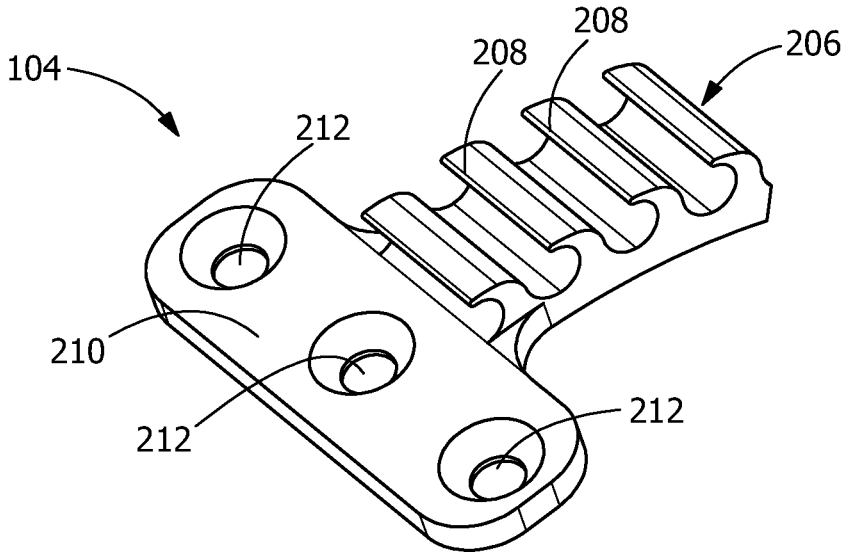
FIG. 2 is a perspective view of a triple eyelet fastener inside strap according to an embodiment of the present invention.
Figure 3:
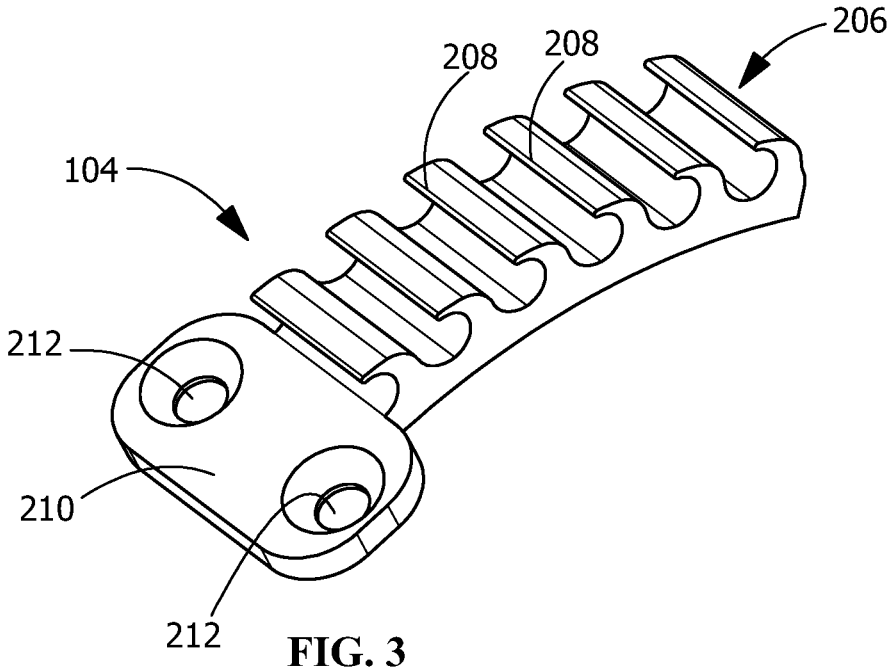
FIG. 3 is a perspective view of the double eyelet fastener inside strap according to an embodiment of the present invention.
Figure 4:
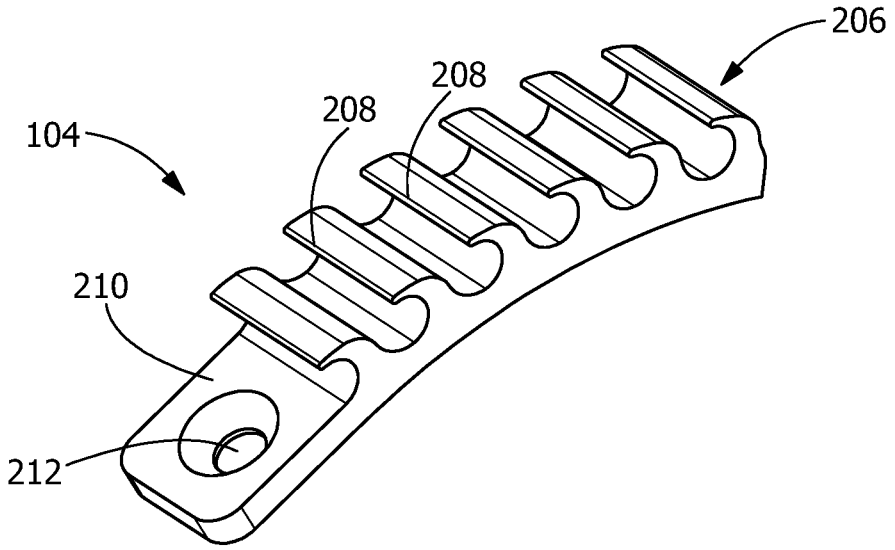
FIG. 4 is a perspective view of the single eyelet fastener inside strap according to an embodiment of the present invention.

FIG. 2 shows inside strap 104 for attachment to footwear 100. Inside strap 104 includes a top side 206 including a plurality of ribs 208. The number of ribs 208 is not particularly limited and may include any suitable number of ribs 208 that provide desired sizing for the user of the footwear 100. The inside strap further includes an inside strap footwear attachment structure 210 having fastener openings 212. In one embodiment, the fastener openings 212 are non threaded openings sized to permit the passage of a fastener, such as a screw. The arrangement shown in FIG. 2 includes an inside strap having three fastener openings 212. FIG. 3 shows an arrangement of inside strap 104 including the same structure as shown and described with respect to FIG. 2. However, FIG. 3 includes two fastener openings 212. FIG. 4 shows an arrangement of inside strap 104 including the same structure as shown and described with respect to FIG. 2. However, FIG. 4 includes one fastener opening 212.

Figure 5:
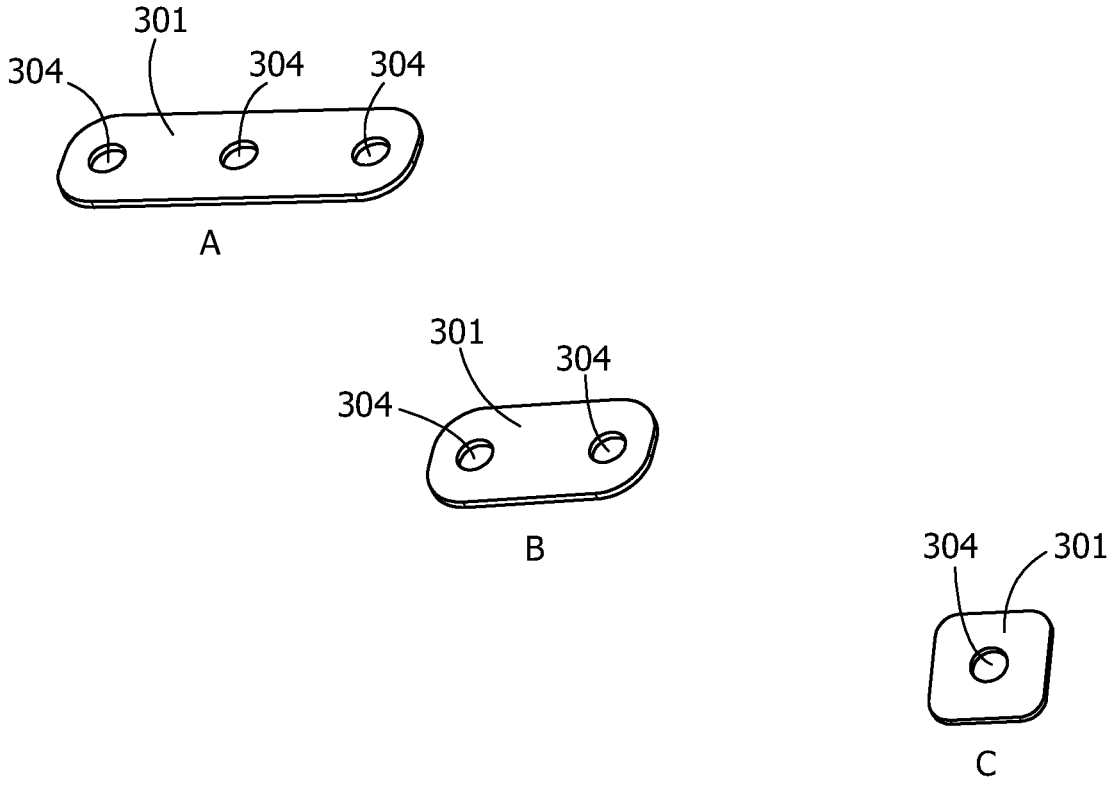
FIG. 5 is a perspective view showing the single, double and triple eyelet backplate for use with fasteners according to an embodiment of the invention.

FIG. 5 includes back plates 301 to receive fasteners, such as screws in threaded receivers 304. Threaded receivers 304 are configured to receive a fastener passed through the fastener opening 212 of inside attachment structure 210 and an eyelet 102 of footwear 100. Three embodiments are shown in FIG. 5, including A, which includes three threaded receivers 304, corresponding to the inside strap 104 of FIG. 2. B of FIG. 5 includes two threaded receivers 304, which correspond to the inside strap 104 of FIG. 3. C of FIG. 5 includes one threaded receiver 304, which corresponds to the inside strap 104 of FIG. 4.

Figure 6:
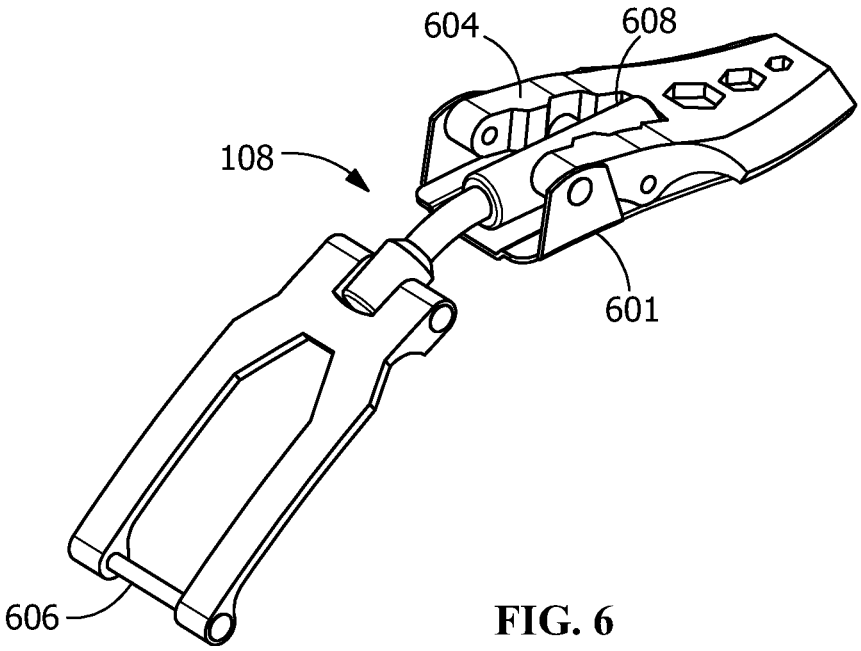
FIG. 6 is a perspective view of an outside strap according to an embodiment of the present invention.

FIG. 6 shows an outside strap 108 according to an embodiment of the present invention. The outside strap 108 includes an outside strap footwear attachment structure 601 having a fastener opening 212 (not visible in FIG. 6) similar to the fastener opening 212 of the inside strap footwear attachment structure 210. In addition, outside strap 108 includes a clasp/buckle mechanism 604 for engaging the ribs 208 of the inside strap 104. Clasp/buckle mechanism 604 includes an engagement bar 606 that releasably engages ribs 208 to hook over the desired rib 208 on the inside strap 104, the clasp/buckle mechanism 604 would then be closed and adjusted using the adjustment screw 608. Adjustment screw 608 includes a threaded arrangement that rotates and adjusts the length of the clasp/buckle mechanism 604 in order to adjust the size to a desired size. Although not shown in FIG. 6, the outside strap 108 of FIG. 6 would include a back plate 301, as shown as C of FIG. 5 having one threaded receiver 304. As with the inside strap 104, a fastener is passed through the fastener opening 212 of the outside strap footwear attachment structure 601, through an eyelet 102 of the footwear and into the threaded receiver 304 of the back plate 301. The ratchet or clasp/buckle mechanism 604 of outside strap 108 is configured to pull the mechanism tight to a users' preference. In addition, ratchet or clasp/buckle mechanism 604 of outside strap 108 is configured to release the ribbed or toothed inside strap 104, for example, by pressing downward. In one embodiment, the buckle is lifted and the clasp unhooked to release the mechanism.

The material of construction for the back plates 301, the inside strap 104 and the outside strap 108 include, but are not limited to, aluminum alloys, stainless steel, zinc alloys, titanium, platinum, leather, rubber, plastics, Kevlar, nylon, synthetics, neoprene, carbon composites. In one embodiment, the inside strap 104 is made of a metal or hard plastic and the outside strap is made of a metal for use in harsh and demanding environments. In another embodiment, the inside strap includes the ribbed top side and the outside strap includes the ratchet, the ribbed top side and the ratchet being made of a flexible plastic, the balance of the inside strap and the outside strap being made of a soft, pliant and flexible material.

Figure 7:
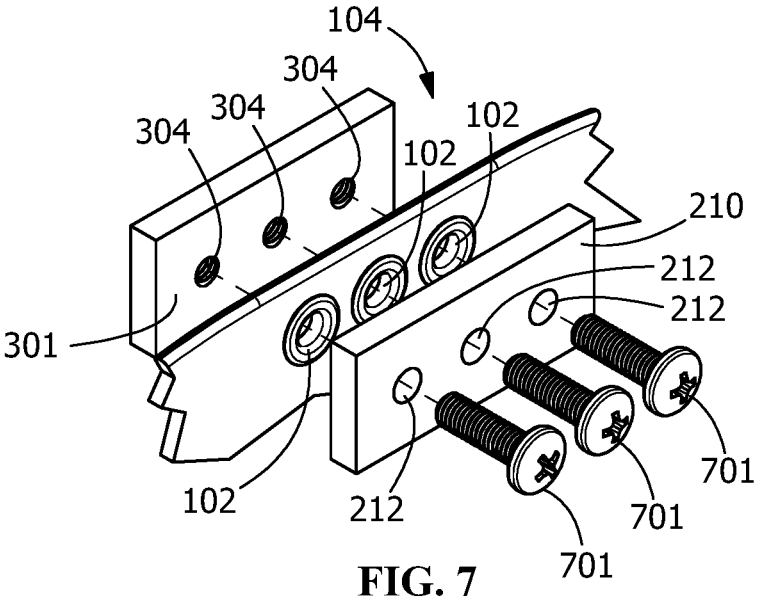
FIG. 7 is an exploded perspective view of the attachment of a triple eyelet fastener inside strap according to an embodiment of the present invention.

FIG. 7 illustrates an embodiment where an inside strap 104 is connected to footwear 400 via fasteners 701. As shown in FIG. 7, the fasteners 701 or screws, pass though inside strap footwear attachment structure 210, eyelets 102 of footwear 400 and are threaded into back plate 301 via threaded receivers 304.

Figure 8:
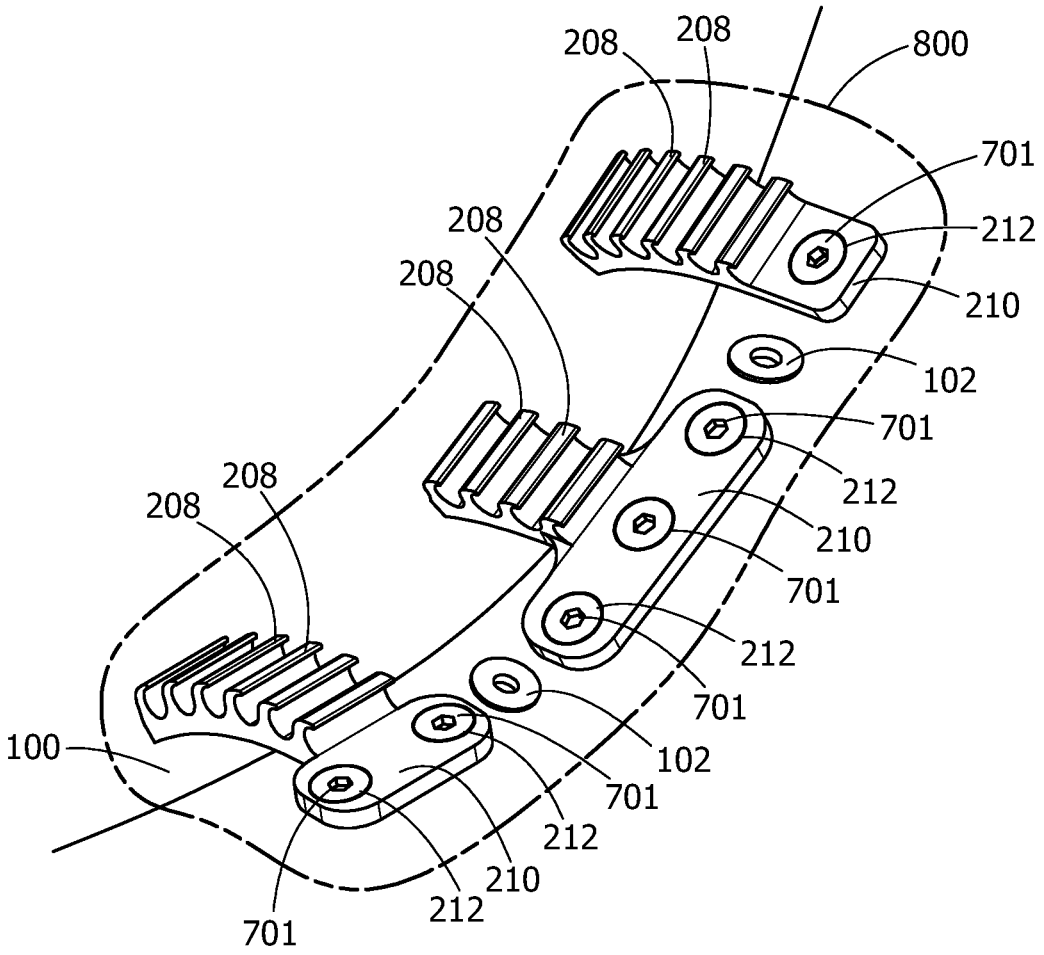
FIG. 8 is an enlarged view of the inside straps of a portable footwear tightener according to an embodiment of the present invention.

FIG. 8 shows an enlarged view of section 800 of FIG. 1, wherein the inside straps 104 are attached according to mechanism shown and described in FIG. 7. Specifically, fasteners 701 are passed through inside strap footwear attachment structure 210 and eyelets 102 of footwear 100. The fasteners 701 are threaded into a back plate 301 (not visible in FIG. 8) to secure the inside straps 104. The outside straps 108 are attached via essentially the same mechanism.

Figure 9:
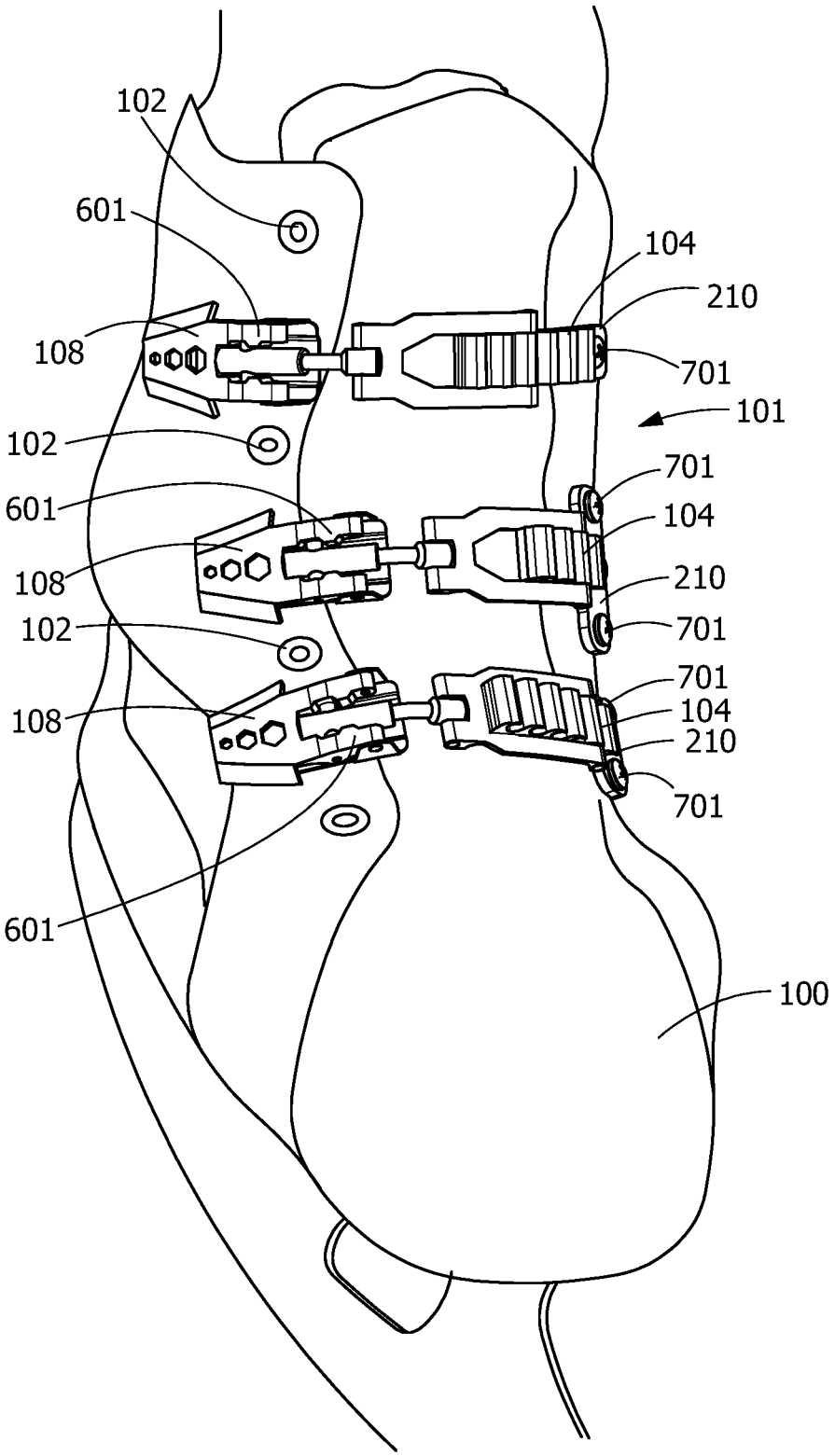
FIG. 9 is a perspective view of the footwear including a portable footwear tightener according to FIG. 1 in a closed position.

FIG. 9 shows footwear 100 as an ice skate, including a portable footwear tightener 101 installed thereon engaged on the eyelets 102 of footwear 100. The portable footwear tightener 101 including an inside strap 104 engaged with an outside strap 108. As shown, the outside strap 108 draws down into a snug position to tighten the footwear around the foot of the wearer. Although not so limited, the embodiment shown in FIG. 9 includes a portable footwear tightener 101 having three sets of inside straps 104 and outside straps 108. Each of the outside straps 108 engages a single eyelet 102 and the inside straps 104 engage one eyelet 102, three eyelets 102 and two eyelets 102, respectively. The embodiment shown in FIG. 9 includes the inside straps 104 and the outside straps 108 connected to the footwear by fasteners 701 passing through the inside strap footwear attachment structure 210 and outside strap footwear attachment structures 601 and engage corresponding threaded receivers 304 of backplates 301 (not visible in FIG. 9).

Figure 10:
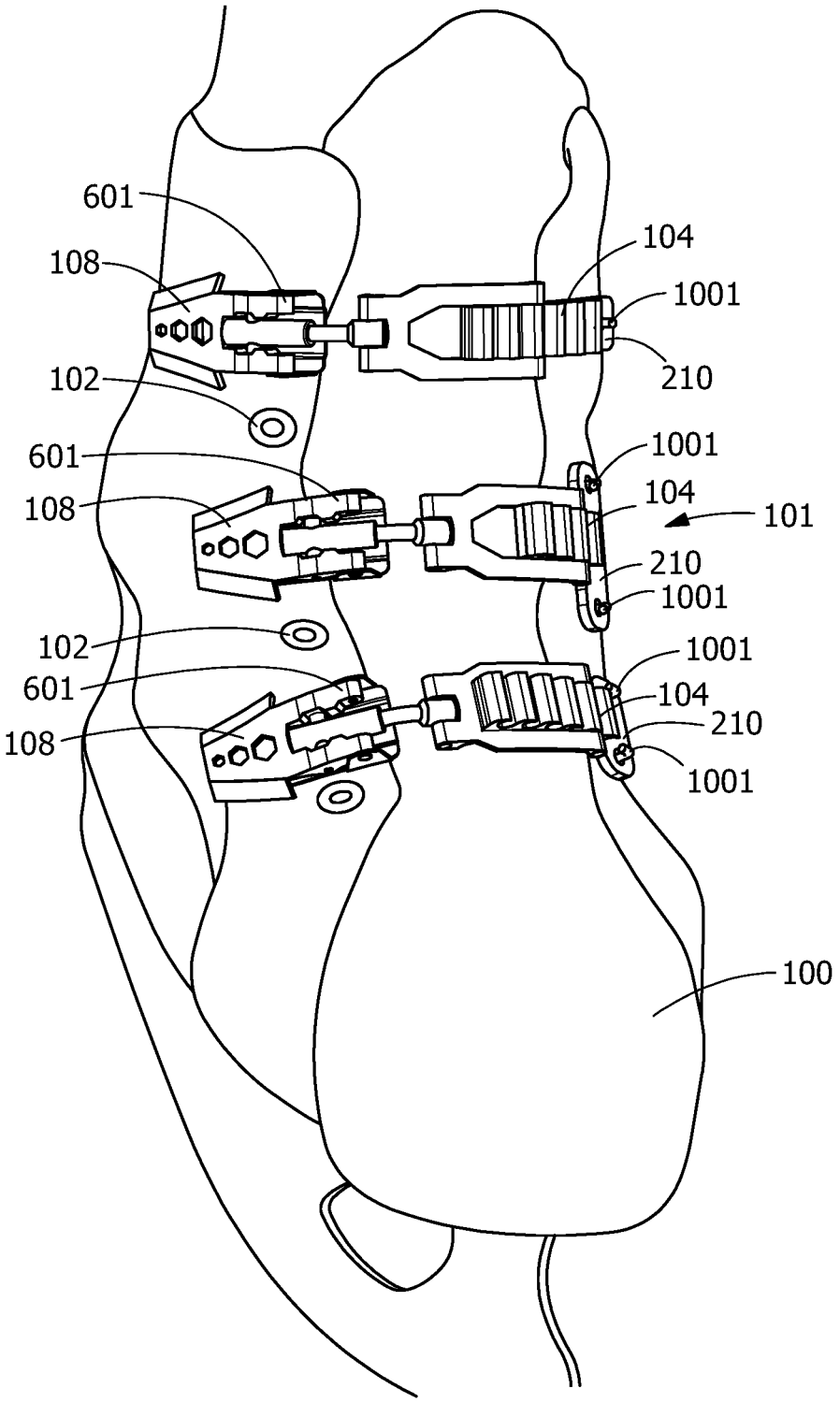
FIG. 10 is a perspective view of footwear including a portable footwear tightener according to an alternate embodiment of the present invention.

FIG. 10 shows an alternate embodiment of footwear 100 as an ice skate, including a portable footwear tightener 101 installed thereon engaged on the eyelets 102 of footwear 100. The portable footwear tightener 101 including an inside strap 104 engaged with an outside strap 108. As shown, the outside strap 108 draws down into a snug position to tighten the footwear around the foot of the wearer. Although not so limited, the embodiment shown in FIG. 10 includes a portable footwear tightener 101 having three sets of inside straps 104 and outside straps 108. Each of the outside straps 108 engages a single eyelet 102 and the inside straps 104 engage one eyelet 102, three eyelets 102 and two eyelets 102, respectively. The embodiment shown in FIG. 10 includes the inside straps 104 connected to the footwear by hooks 1001 passing through the inside inner side of the footwear and outwardly through a corresponding eyelet 102. In one embodiment, the hooks 1001 wrap around the top edge of the footwear eyelets. The hooks 1001 are sized to fit through eyelet 102. Similarly, the outside straps 108 include hooks 1001 (not visible in FIG. 10) that hook outwardly into the eyelet 102. The portable footwear tightener 101 may include the same or different attachment mechanisms for the inside strap 104 and the outside strap 108. For example, the inside strap 104 may utilize hooks 1001, while the outside strap 108 may utilize fasteners 701 and back plates 301. As the portable footwear tightener 101 is tightened, the hooks 1001 pull tight against the footwear 100.

Figure 11:
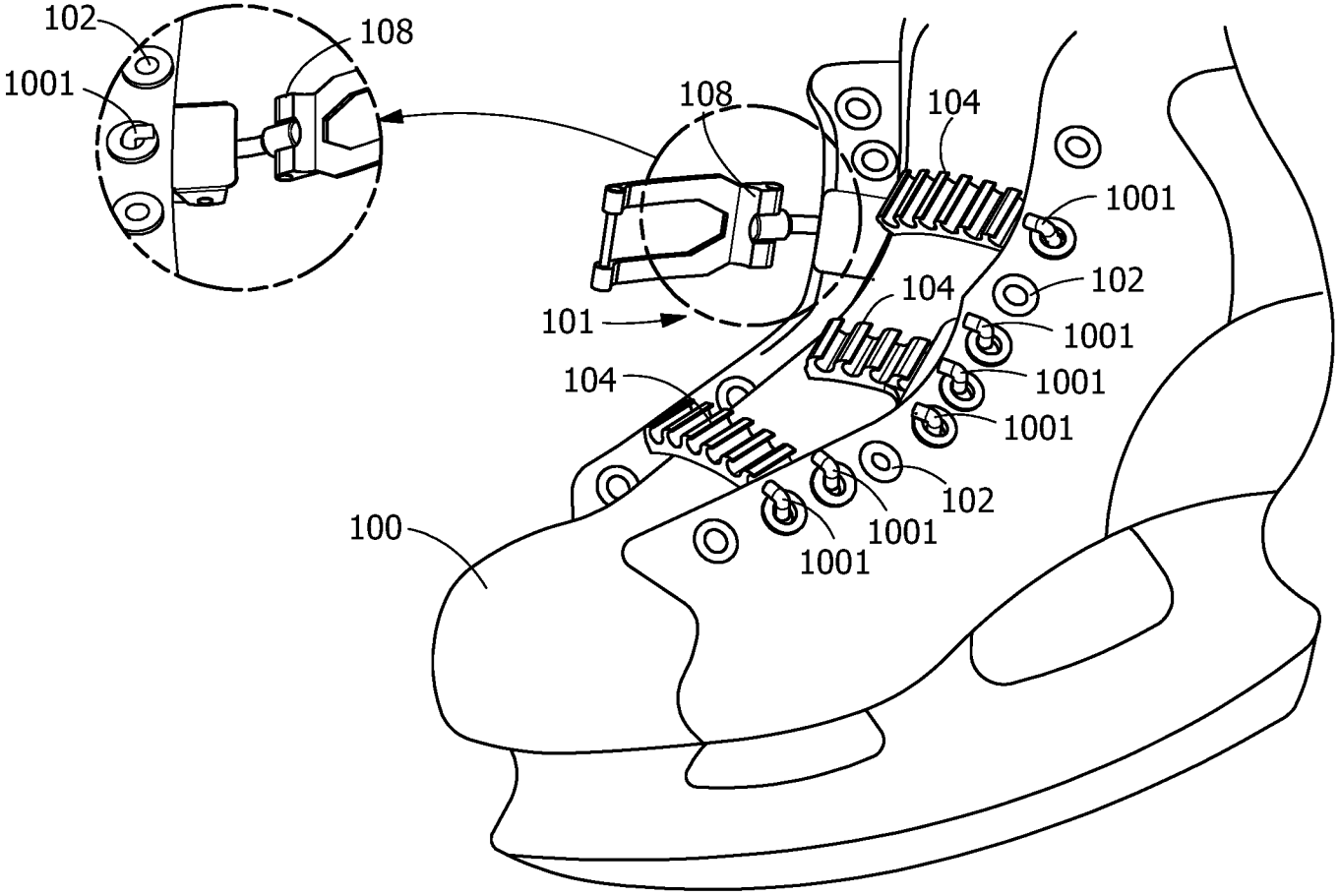
FIG. 11 is a perspective view of the footwear including a portable footwear tightener according to FIG. 10 in an open position.

FIG. 11 shows the embodiment of the footwear 100 including the arrangement of portable footwear tightener 101 shown in FIG. 10, wherein the inside strap 104 and outside strap 108 are disengaged. In addition, FIG. 11 shows an enlarged detail viewed from the opposite site showing the attachment of the outside strap 108, wherein hook 1001 in inserted from the inner side of the footwear 100 through eyelet 102. While the hooks 1001 shown and described in FIGS. 10 and 11 are inserted from the inside of the footwear 100, another embodiment may include hooks 1001 that are inserted from the outside of the footwear 100 through the eyelets 102.

Figure 12:
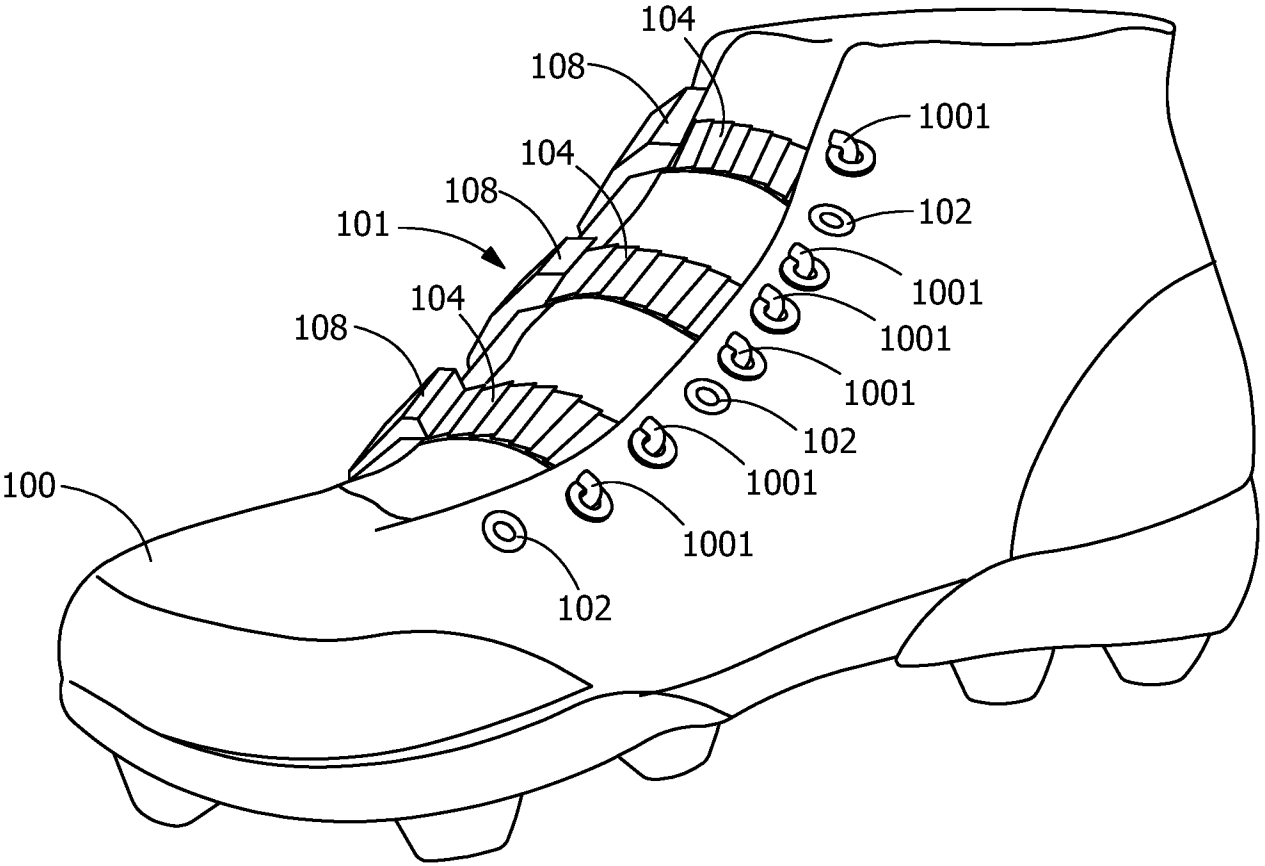
FIG. 12 is a perspective view of footwear including a portable footwear tightener according to an alternate embodiment of the present invention.

FIG. 12 shows an alternate embodiment of the footwear 100 including the arrangement of portable footwear tightener 101 that includes a latch mechanism which utilizes a ratchet hasp in lieu of a clasp and a ribbed inside strap in lieu of a toothed strap as shown in the previous embodiments. FIG. 12 shows the hook attachment shown and described in FIGS. 10 and 11 with the ratchet style tightening system attached to an athletic shoe. As the portable footwear tightener 101 is tightened, the hooks 1001 pull tight against the footwear 100 and the hasp providing the required fastening/tightening.

Figure 13:
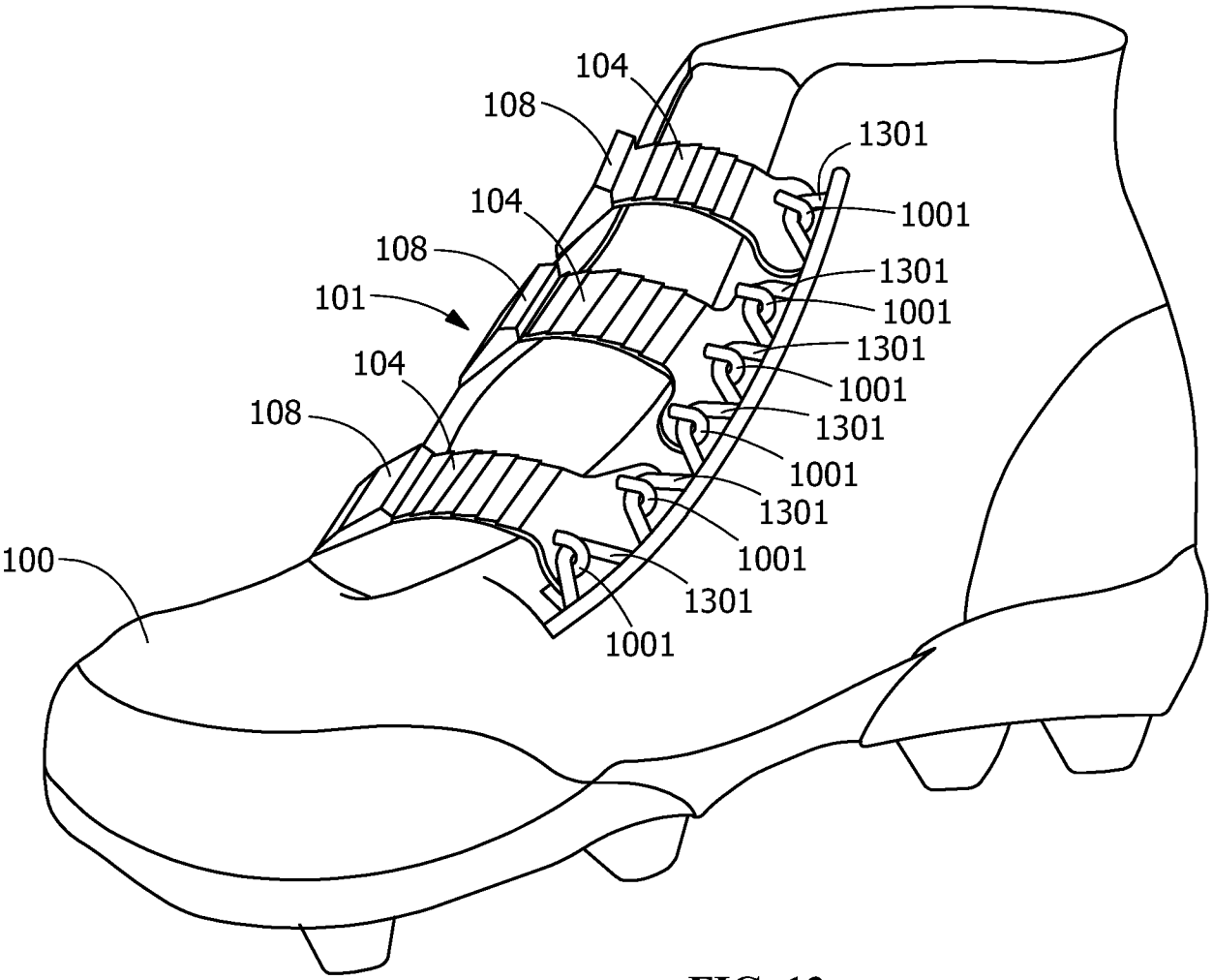
FIG. 13 is a perspective view of footwear including a portable footwear tightener according to an alternate embodiment of the present invention.

FIG. 13 shows an alternate embodiment of the footwear 100 including the arrangement of portable footwear tightener 101. FIG. 13 shows an attachment with a hook attachment, similar to the portable footwear tightener 101 shown and described with respect to FIG. 12 utilizing a ratchet style tightening system attached to a work boot. However, footwear 100 shown in FIG. 13 includes loops 1304 that would otherwise receive laces or similar structures. To install the portable footwear tightener 101 shown in FIG. 13, hooks 1001 are directed through the loops 1304.

Figure 14:
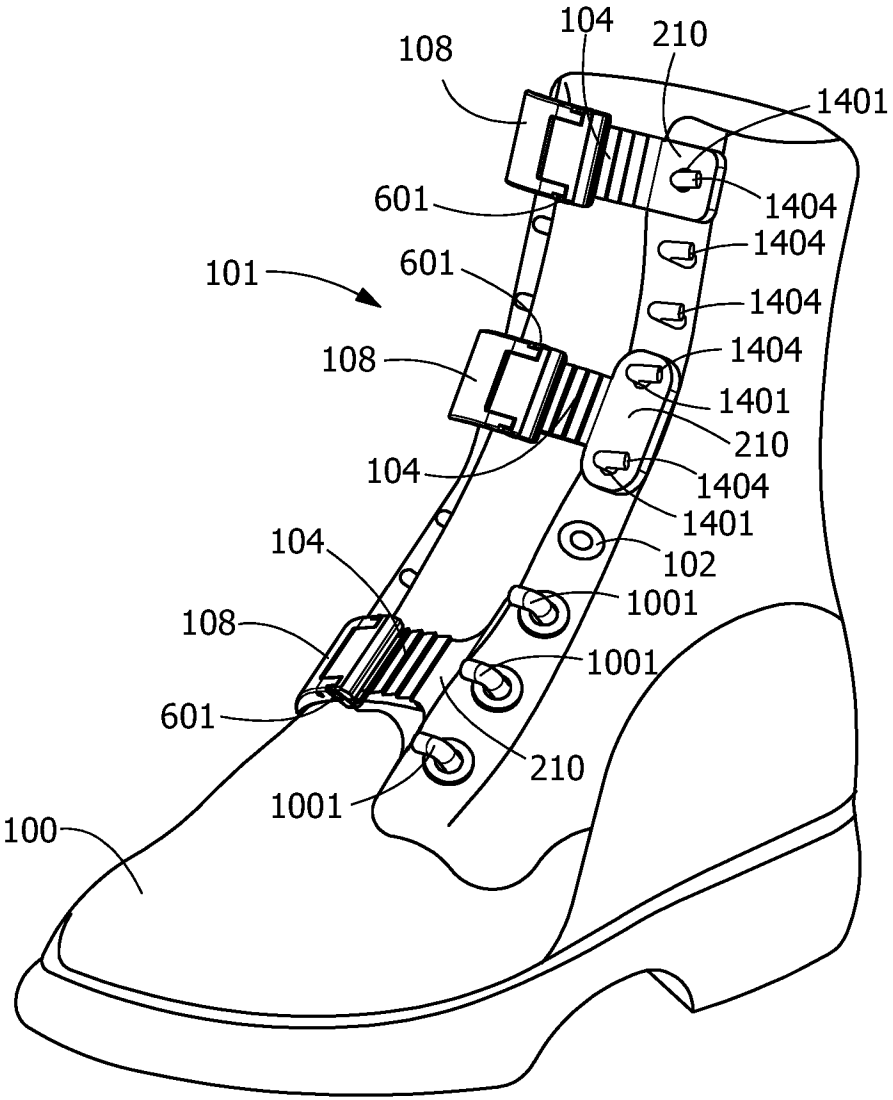
FIG. 14 is a perspective view of footwear including a portable footwear tightener according to an alternate embodiment of the present invention.

FIG. 14 shows an alternate embodiment of the footwear 100 including the arrangement of portable footwear tightener 101. The inside straps 104 and outside straps 108 includes a ratchet style tightening system attached to a work boot. FIG. 14 shows a combination of attachment of the inside strap 104 and the outside strap 109 by both a hook 1001 (on the lower portion of the footwear 100) and by a hoop attachment having hoop receivers 1401 (on the two upper sets of inside strap 104 and outside strap 109). The hoop receivers 1401 are present on the inside strap footwear attachment structure 210 and outside strap footwear attachment structure 601 of the inside strap 104 and outside strap, respectively. The hoop receivers 1401 include openings, similar to eyelets found on footwear, which are sized to receive eyelet hooks 1404. The hoop receivers 1401 permit attachment for footwear 100 that have some or all eyelet hooks 1404.

Figure 15:
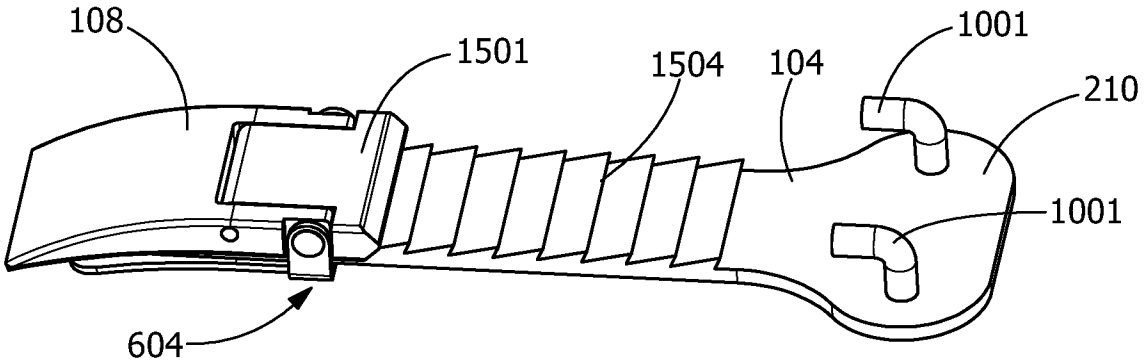
FIG. 15 is a perspective view of a ratchet with hook mechanism according to an alternate embodiment of the present invention.
Figure 16:
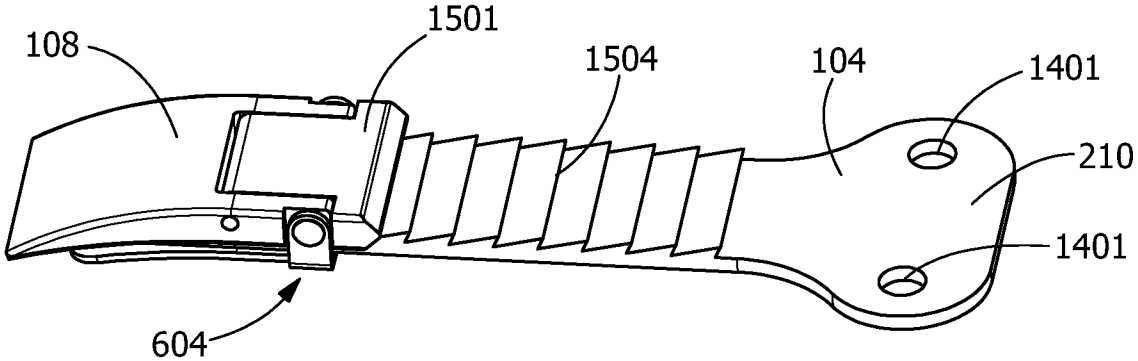
FIG. 16 is a perspective view of a ratchet with hook mechanism according to an alternate embodiment of the present invention.

FIGS. 15 and 16 illustrate examples of the latching mechanism using a ratchet hasp 1501 with a ribbed strap 1504. FIG. 15 shows the latching mechanism with hook attachments on the inside strap footwear attachment structure 210 and outside strap footwear attachment structure 601, similar to that shown and described in FIGS. 10-12 and 14. FIG. 16 shows the latching mechanism with eyelet hoop attachments on the inside strap footwear attachment structure 210 and outside strap footwear attachment structure 601, similar to that shown and described in FIG. 14. The ratchet hasp 1501 of the outside strap 108 shown in both FIGS. 15 and 16 releasably engages the ribbed strap 1504 of the inside strap 104 and can be tightened by a lifting of the left side lever of the ratchet hasp 1501, which advances the ratchet hasp 1501 along the ribbed strap 1501. The ratchet hasp 1501 may be released by pushing on the right side of the ratchet hasp 1501, which releases the ratchet hasp from the ribbed strap 1504.

Figure 17:
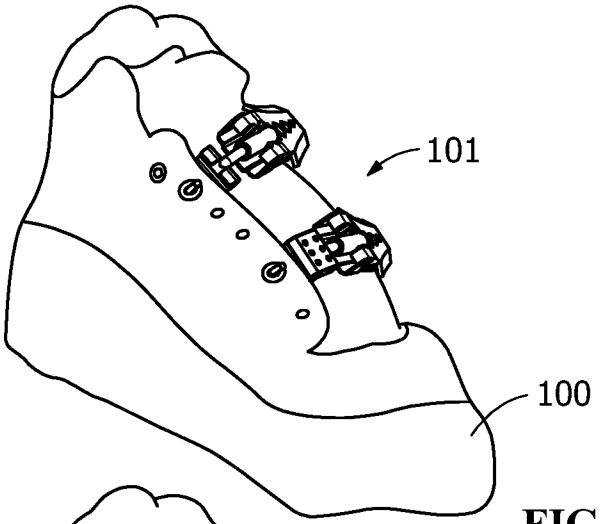
FIG. 17 is a perspective view of footwear including a portable footwear tightener according to an alternate embodiment of the present invention.
Figure 18:
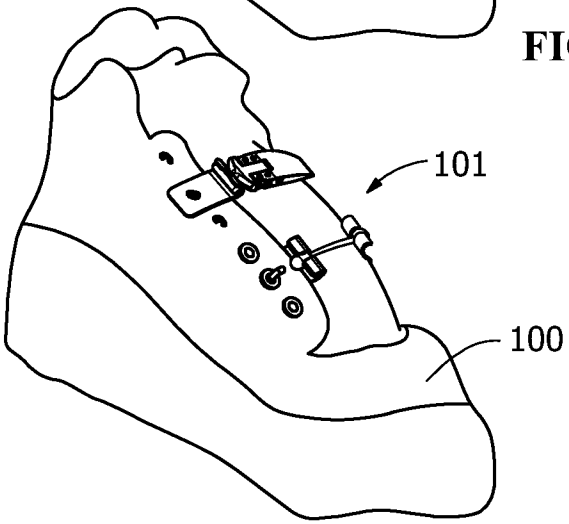
FIG. 18 is a perspective view of footwear including a portable footwear tightener according to an alternate embodiment of the present invention.

FIGS. 17 and 18 show an alternate embodiment of the footwear 100 including the arrangement of portable footwear tightener 101 that includes an alternate method of tightening the latch mechanism having a size and configuration suitable for sneakers or casual shoes.

Figure 19:
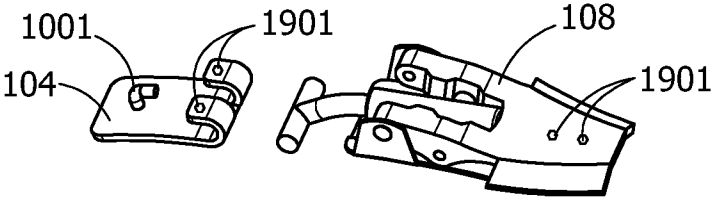
FIG. 19 is a perspective view of a designer clasp, using each of the pre-defined connections methods, with a custom designer covering for use in fashion according to an alternate embodiment of the present invention.
Figure 20:
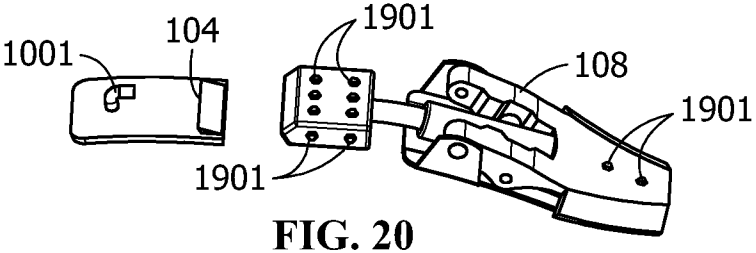
FIG. 20 is a perspective view of a designer clasp according to an alternate embodiment of the present invention.
Figure 21:
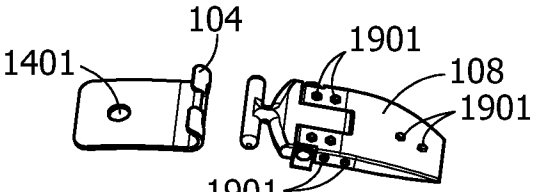
FIG. 21 is a perspective view of a designer clasp according to an alternate embodiment of the present invention.
Figure 22:
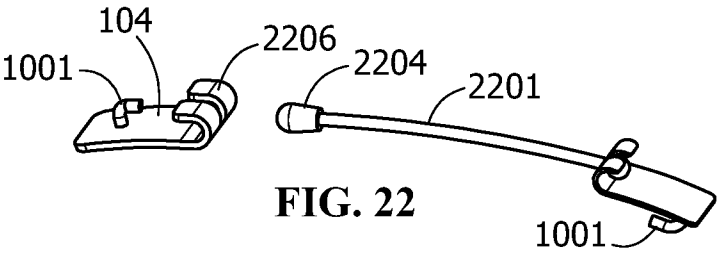
FIG. 22 is a perspective view of a designer clasp according to an alternate embodiment of the present invention.

FIGS. 19-22 show alternate embodiments of the footwear 100 including the arrangement of portable footwear tightener 101. FIGS. 19, 20 and 22 show a hook arrangement for attaching the portable footwear tightener 101 to the footwear, similar to that shown and described with respect to FIGS. 10, 11, 12, 14 and 15. FIG. 21 includes a hoop receivers 1401 for attaching the portable footwear tightener 101 to the footwear, similar to that shown and described with respect to FIGS. 14 and 16. FIG. 22 includes an alternate engagement system for engaging the inside strap 104 to the outside strap. As shown in FIG. 22, the outside strap 108 includes a flexible arm 2201, formed from a suitable elastic material, having an engagement head 2204 that is received into an arm receive 2206 on the inside strap 104. The elastic material pulls the inside strap 104 and the outside strap 108 snug. In some embodiments, the portable footwear tightener 101 may include custom design latch mechanisms using precious metals or jewels, such as rubies or diamonds, for fashion on sneakers or casual footwear 100. In FIGS. 19-22, jewels 1901 are displayed on various surfaces for decorative display purposes. The arrangement of and the specific jewels utilized are not particularly limited and may include any visually pleasing object or material.

The spacing between the eyelet attachments will vary and will be based upon known footwear configurations. The spacing of the eyelets may require unequal or irregular spacing depending on the style and type of footwear. For example, a hockey skate may have equal spacing between eyelets for uniform lace tightening, but an athletic shoe may have closer eyelets near the ankle and farther apart eyelets nearer the toe.

While the invention has been described with reference to one or more embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A portable footwear tightener for footwear having eyelets, eyelet hooks, or loops, comprising: an inside strap having a tooth or ribbed top side; an inside strap footwear attachment structure; an outside strap having a ratchet or clasp/buckle mechanism; an outside strap footwear attachment structure; wherein each of the inside strap and the outside strap is attached to the footwear through the eyelets, hooks, or hoops by the inside strap footwear attachment structure and the outside footwear attachment structure, respectively, and the ribbed or toothed portion of the inside strap is connectable to ratchet or clasp/buckle mechanism of the outside strap into a snug arrangement;

wherein one or both of the inside footwear attachment structure and the outside footwear attachment structure includes one or more fasteners and a back plate;

wherein the fasteners are screws;

wherein the back plate includes threaded eyelets and is arranged and disposed on the underside of the eyelets of the footwear, and the associated inside or outside strap attachment structures include non-threaded eyelets and is arranged and disposed on the top side of the eyelets of the footwear connecting the inside and outside straps via the eyelets of the footwear by screwing of the screws into the back plate.

2. The portable footwear tightener of claim 1, wherein the ratchet or clasp/buckle mechanism of the outside strap is configured to pull the mechanism tight to a users' preference.

3. The portable footwear tightener of claim 2, wherein the ratchet or clasp/buckle mechanism of the outside strap is further configured to release the ribbed or toothed strap.

4. The portable footwear tightener of claim 1, wherein the inside strap includes a toothed upper side where the teeth are arranged and disposed to receive a clasp connected to a buckle located on the outside strap.

5. The portable footwear tightener of claim 4, wherein the clasp engages a tooth corresponding to a desired size, while the buckle is then pulled closed over the outside strap.

6. The portable footwear tightener of claim 4, wherein the buckle is lifted and the clasp un-hooked to release the mechanism.

7. The buckle of claim 5, further includes an adjustment screw for added adjustment.

8. The portable footwear tightener of claim 1, including a ribbed upper side made up of a plurality of ribs where the ribs are arranged and disposed to be inserted in a ratchet mechanism located on the outside strap, the ratchet being configured to pull the straps tight one rib at a time to the desired tightness.

9. The portable footwear tightener of claim 1, wherein the ratchet, upon pressing down, releases the ribbed strap loosening the mechanism.

10. The portable footwear tightener of claim 1, wherein the inside strap is made of a metal or hard plastic and the outside strap is made of a metal for use in harsh and demanding environments.

11. The portable footwear tightener of claim 1, wherein the inside strap includes the ribbed top side and the outside strap includes the ratchet, the ribbed top side and the ratchet being made of a flexible plastic, the balance of the inside strap and the outside strap being made of a soft, pliant and flexible material.

12. The portable footwear tightener of claim 1, wherein one or both of the inside strap or outside strap includes a material of construction selected from the group consisting of aluminum alloys, stainless steel, zinc alloys, titanium, platinum, leather, rubber, plastics, Kevlar, nylon, synthetics, neoprene, carbon composite and combinations thereof.

* * * * *